US009528742B2

(12) United States Patent
Koch et al.

(10) Patent No.: US 9,528,742 B2
(45) Date of Patent: Dec. 27, 2016

(54) REFRIGERATING DEVICE COMPRISING A FAN

(71) Applicant: BSH BOSCH UND SIEMENS HAUSGERÄTE GMBH, München (DE)

(72) Inventors: Alexander Koch, Neu-Ulm (DE); Michaela Malisi, Heidenheim (DE); Renate Pradel, Giengen (DE)

(73) Assignee: BSH Hausgeräte GmbH, Munich (DE)

( * ) Notice: Subject to any disclaimer, the term of this patent is extended or adjusted under 35 U.S.C. 154(b) by 215 days.

(21) Appl. No.: 14/377,971

(22) PCT Filed: Jan. 21, 2013

(86) PCT No.: PCT/EP2013/051003

§ 371 (c)(1),
(2) Date: Aug. 11, 2014

(87) PCT Pub. No.: WO2013/117412

PCT Pub. Date: Aug. 15, 2013

(65) Prior Publication Data

US 2015/0047386 A1 Feb. 19, 2015

(30) Foreign Application Priority Data

Feb. 9, 2012 (DE) ..... 10 2012 201 883

(51) Int. Cl.
*F25D 17/06* (2006.01)
*F25D 11/00* (2006.01)

(52) U.S. Cl.
CPC ..... *F25D 17/062* (2013.01); *F25D 11/00* (2013.01); *F25D 17/067* (2013.01); *F25D 2317/0681* (2013.01); *Y10T 29/49327* (2015.01)

(58) Field of Classification Search
CPC ..... F25D 17/062; F25D 11/00; F25D 17/067; F25D 2317/0681; Y10T 29/49327
See application file for complete search history.

(56) References Cited

U.S. PATENT DOCUMENTS 5,351,503 A 10/1994 Sugimoto et al.
6,272,876 B1 8/2001 Roberts et al.
7,596,960 B2 * 10/2009 Bae ..... F24F 1/0007 62/263

FOREIGN PATENT DOCUMENTS

CN 1435632 8/2003
CN 1727768 2/2006
(Continued)

OTHER PUBLICATIONS

International Search Report for PCT/EP2013/051003, mailed Apr. 5, 2013.
(Continued)

*Primary Examiner* — Emmanuel Duke
(74) *Attorney, Agent, or Firm* — Nixon & Vanderhye P.C.

(57) ABSTRACT

A refrigerating device has an evaporator, a fan, a fan housing for generating an air flow on the evaporator, and a bearing shell for retaining the fan housing on the evaporator in a vibration-decoupled manner. The fan housing has at least one first bearing pin and a second bearing pin. The bearing shell has at least one first receiving recess for receiving the first bearing pin in a pivotal manner and a second receiving recess for receiving the second bearing pin, and a pivotal locking element is provided for locking the second bearing pin in the second receiving recess.

20 Claims, 3 Drawing Sheets

(56) References Cited

FOREIGN PATENT DOCUMENTS

| | | | | |
|---|---|---|---|---|
| CN | 101263351 | | 9/2008 | |
| CN | 101498313 | | 8/2009 | |
| CN | 101688728 | | 3/2010 | |
| DE | 20 2005 014370 | | 7/2006 | |
| DE | 2009376 | A1 * | 12/2008 | ..... F25D 17/067 |
| DE | 10 2009 045343 | | 4/2011 | |
| EP | 2009376 | | 12/2008 | |
| RU | 2 434 188 | C2 | 8/2009 | |
| RU | 2 405 118 | C2 | 10/2009 | |
| WO | 9958914 | | 11/1999 | |
| WO | 2007115866 | | 10/2007 | |
| WO | 2011042307 | | 4/2011 | |

OTHER PUBLICATIONS

Written Opinion of the International Searching Authority for PCT/EP2013/051003, mailed Apr. 5, 2013.

* cited by examiner

REFRIGERATING DEVICE COMPRISING A FAN

This application is the U.S. national phase of International Application No. PCT/EP2013/051003 filed 21 Jan. 2013 which designated the U.S. and claims priority to DE 10 2012 201 883.2 filed 9 Feb. 2012, the entire contents of each of which are hereby incorporated by reference.

The present invention relates to a refrigerating device.

BACKGROUND

With many refrigerating devices, vibrations arise in fans, these being transmitted via the fan's fixing elements to an evaporator in the refrigerating device, for example, and are then radiated out into the surroundings in the form of noise. These noise emissions are perceived as disturbing.

At the same time, the market situation requires that all potential cost savings in the manufacture of refrigerating devices are exploited. The fan should therefore be simple to assemble and its attachment realizable at low cost.

Because fans have parts which move, in particular fan-wheels, which are subject to wear, being able to replace the fan simply is advantageous. The fan should accordingly be rapid and easy to mount and remove.

In the context of the globalization of markets, refrigerating devices are increasingly transported over long distances, in some cases being subject to severe jolts. It is thus desirable that the fan is affixed to the refrigerating device so that it is secure against dislodgement, even when the refrigerating device is jolted. Due to the great differences in the aids available in the various markets, it is advantageous if the fan can be replaced without special tools.

SUMMARY

It is therefore the object of the present invention to make available a refrigerating device in which it is cheap and technically simple to attach a fan to the refrigerating device, in particular to the evaporator, so that it is secure against jolting, and so that it isolates vibrations and can be simply removed.

a refrigerating device in accordance with the independent claim 1. Further advantageous embodiments are specified in the subclaims.

One aspect of the invention relates to a refrigerating device with an evaporator, together with a fan and a fan housing for the generation of an airflow at the evaporator, and with a bearing shell for holding the fan housing on the evaporator while isolating the latter from vibrations, where the fan housing has at least one first bearing pin and a second bearing pin, the bearing shell has at least one seating recess for seating the first bearing pin in such a way that it can pivot, and a second seating recess for seating the second bearing pin, and that a pivotable locking element is provided for the purpose of locking the second bearing pin in the second seating recess.

The fan has, for example, an external rotor fan motor. An external rotor is a form of construction for an electric motor whereby the stationary part (the stator) of the motor is in the inside, and is surrounded by the moving part (the rotor). These can, for example, be asynchronous motors with a squirrel-cage rotor. In the case of electronically commutated DC motors with an external rotor construction, the rotor consists, for example, of several alternately radially aligned permanent magnets arranged in a ring-shape or a corresponding four-pole magnetized ring.

A cooling circuit in the cooler incorporates, for example, a compressor for compressing coolant vapor, a liquifier downstream from the compressor for condensing the coolant vapor and the evaporator, downstream from the liquifier and upstream from the compressor, for evaporating the liquified coolant. The liquifier is equipped, as is the evaporator, for transferring heat between air which is fed to it and the fluid in the cooling circuit.

The term refrigerating device is to be understood, in particular, as a domestic refrigerating device, that is a refrigerating device which is used for housekeeping in households or in the catering sector, and serves in particular to store food and/or beverages at particular temperatures, such as for example a refrigerator, a freezer, a combined fridge-freezer, a chest freezer or a wine cooling cabinet.

In accordance with one form of embodiment, the first bearing pin and the second bearing pin are each provided with ring-shaped damping elements, in particular ring-shaped rubber bushes, for vibration isolation. By this means, vibration isolation can be achieved, in particular if the fan is attached to the evaporator by means of the bearing shell. The vibrations of the fan housing are not, or only to a limited extent, transmitted to the evaporator. The damping element concerned can be elastic, for example made of rubber. The damping element concerned enables the fan housing to be located on the evaporator, while at the same time preventing or reducing the transmission of vibrations from the housing to the evaporator. By this means the emissions of noise, from the evaporator to the environment, which result from the radiation of sound waves produced by vibrations transmitted from the housing of the fan, are avoided. The noise emissions from the refrigerating device are thereby improved.

In accordance with one form of embodiment, the first bearing pin can be introduced into the first seating recess and forms a pivot axis for a pivoted mounting of the fan housing relative to the bearing shell. For the pivoting mounting, a third bearing pin can be provided, and this can be arranged to be at the same height as the first bearing pin, i.e. along the pivot axis. The fan housing is thereby arranged so that it can pivot on the first bearing pin.

In accordance with one form of embodiment, the second bearing pin can be pivoted into the second seating recess. This can be realized, for example, by pivoting the fan housing on the pivot axis mentioned above.

In accordance with one form of embodiment, the first seating recess is formed as an elongated slot, open on an edge, into which the first bearing pin can be placed. By this means, secure holding of the first bearing pin is achieved.

In accordance with one form of embodiment, the fan housing has a third bearing pin and a fourth bearing pin, where the bearing shell has at least one third seating recess for seating the third bearing pin so that it can pivot, and a fourth seating recess to seat the fourth bearing pin, where the first bearing pin and the third bearing pin are arranged on the sides of the fan housing and opposite each other, where the second bearing pin and the fourth bearing pin are arranged on the sides of the fan housing and opposite each other, and the locking element for locking the fourth bearing pin is provided in the fourth seating recess. The first and third locating bolts can be arranged beneath or above the second and third locating bolts.

In accordance with one form of embodiment, the bearing pins are attached on the side of the fan housing, where the first, second, third and fourth seating recesses are formed on the side of the bearing shell, in particular in side walls of the bearing shell.

In accordance with one form of embodiment, there is provided on the bearing shell at least one lock seat, in particular a locking bolt, for locking the locking element.

In accordance with one form of embodiment, the locking element has at least one locking hook, which is constructed to engage behind the lock seat, in particular locking bolt, by pivoting. The locking element can have another locking hook, which is arranged opposite the locking hook and engages behind another seat. By this means, the locking element can be locked on both sides of the fan housing.

In accordance with one form of embodiment, the locking element incorporates a mounting bracket which is attached to the fan housing so that it can pivot, where the locking hook concerned is attached to the mounting bracket. The lock can in this way be particularly simply realized.

In accordance with one form of embodiment, the second bearing pin and/or the fourth bearing pin can be locked by a rotational movement of the mounting bracket about a bearing axis of the mounting bracket. In doing so, the locking hooks mentioned above can engage behind the lock seats.

In accordance with one form of embodiment, the mounting bracket can be joined to the bearing shell by means of a latch connector, in particular by means of a latch hook, in such a way that it can be released.

In accordance with one form of embodiment the mounting bracket is mounted on both sides of the bearing shell in such a way, in particular by means of bearing pins, that it can pivot and in a locking position, in which the bearing pin concerned is locked into the applicable second seat, at least partially grips round the bearing shell. By this means, the mounting bracket can be located on the bearing shell and can in addition hold the fan housing.

In accordance with one form of embodiment, the bearing shell is attached to the evaporator, or is formed by an evaporator vessel.

Another aspect of the invention concerns an assembly method for the assembly of a fan with a fan housing, in a refrigerating device, by means of a bearing shell for holding the fan housing while providing vibration isolation, in which the fan housing has at least one first bearing pin and at least one second bearing pin, where the bearing shell has at least one seating recess for seating the first bearing pin so that it can pivot and a second seating recess for seating the second bearing pin, and where a pivotable locking element is provided for the purpose of locking the second bearing pin in the second seating recess. The method includes the introduction of the first bearing pin of the fan housing into the first seating recess in the bearing shell, the pivoting of the second bearing pin into the second seating recess in the bearing shell by pivoting the fan housing about a pivot axis, defined by the first bearing pin, towards the bearing shell, and the locking of the second bearing pin into the second seating recess by the locking element. The bearing pins of the fan housing are fixed in a vertical and a horizontal direction. By a rotational movement about the first bearing axis during assembly, the bearing pins on the fan housing are pivoted into the second bearing shells of the bearing shell, by which means the fan housing is positioned horizontally against the bearing shell. The damping elements prevent direct contact between the bearing pins on the fan housing and the bearing shell.

Further steps in the assembly method result directly from the interoperation of the fan housing with the bearing shell in accordance with the invention.

BRIEF DESCRIPTION OF THE DRAWINGS

Further advantageous embodiments and aspects of the invention are the subject of the subclaims and of the exemplary embodiments of the invention described below. In what follows, the invention is explained in more detail by reference to preferred forms of embodiment, with reference to the attached figures.

These show.

DETAILED DESCRIPTION

Figure 1:
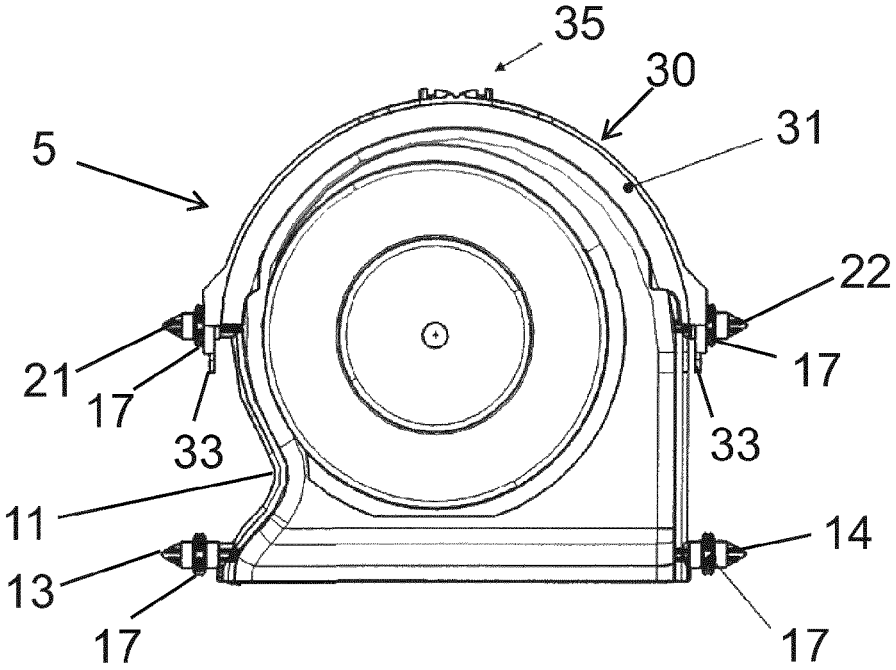
FIG. 1: a schematic diagram, looking from the rear, of a fan for a refrigerating device with the mounting bracket closed, in accordance with a first exemplary embodiment.

FIG. 1 shows a schematic diagram of a fan 5 in a refrigerating device 1 with a fan housing 11. Attached to the sides of the fan housing 11 are bearing pins for fixing the fan housing 11 into recesses in a bearing shell 4. A first bearing pin 13 and a second bearing pin 14 are arranged opposite to each other on the fan housing 11. Above the first and second bearing pins 13, 14, a third bearing pin 21 and a fourth bearing pin 22 are arranged opposite each other on the fan housing 11. The bearing pins 13, 14, 21, 22 are provided to enable attachment of the fan 5 in the bearing shell 4, which can be affixed to an evaporator (not shown in FIG. 1). Attached to the bearing pins 13, 14, 21, 22 are damping elements 17, to effect vibration technology isolation of the fan 5 from the bearing shell 4, and hence from the evaporator. In this exemplary embodiment, the damping elements 17 are in the form of a ring shape, and are pushed onto the bearing pins 13, 14, 21, 22. They effect thereby spacing and damping of the bearing pins 13, 14, 21, 22 both in an axial and also in a radial direction.

For the purpose of locking the second and the fourth bearing pins 21, 22, a locking element 30 is provided, incorporating a mounting bracket 31 with locking hooks 33. FIG. 1 shows a front view of the mounting bracket 31. The mounting bracket 31 runs in a roughly semicircular shape around the bearing shell 4. Latching hooks 35 are provided on the mounting bracket 31 for locking the mounting bracket 31. Provided at the ends of the mounting bracket 31 are locking hooks 33 which, for the purpose of locking the second and fourth bearing pins 21, 22, engage behind corresponding lock seats, for example locking bolts.

The bearing pins 13, 14, 21, 22 on the fan housing 11 ensure a precise positioning of the fanwheel of the fan 5 in the axial and radial directions relative to an inlet nozzle on the bearing shell 4. The vibration isolation is thus characterized by two bearing axes on the fan housing 11, each with bearing pins lying opposite each other, 13, 14 and 21, 22. Pushed onto each of the bearing pins 13, 14, 21, 22 there is a damping element 17, for example with a ring shape. The damping element 17 is manufactured, for example, from rubber. It extends radially, for example, around the bearing pin concerned in such a way that even radial contact between the bearing pins 13, 14, 21, 22 and the evaporator is avoided. By this means, the transmission of vibrations from the fan 5 to the evaporator via the bearing pins 13, 14, 21, 22 is avoided.

For the purpose of assembling the fan housing 11, the first and the third bearing pins 13 and 14 on the fan housing 11 are each introduced into the corresponding seating recess in the bearing shell, which can take the form of elongated slots. After this, the second and the fourth bearing pins 21, 22 are introduced into the corresponding seating recesses in the bearing shell 4 by pivoting the fan housing 11 about a pivot axis, defined by the first bearing pin 13, towards the bearing shell 4. After this, the second and fourth bearing pins 21, 22 are locked into the corresponding seating recesses by the locking element 30. In doing this, the locking hooks 33 engage behind the corresponding lock seats, which can be designed as locking bolts.

Figure 2:
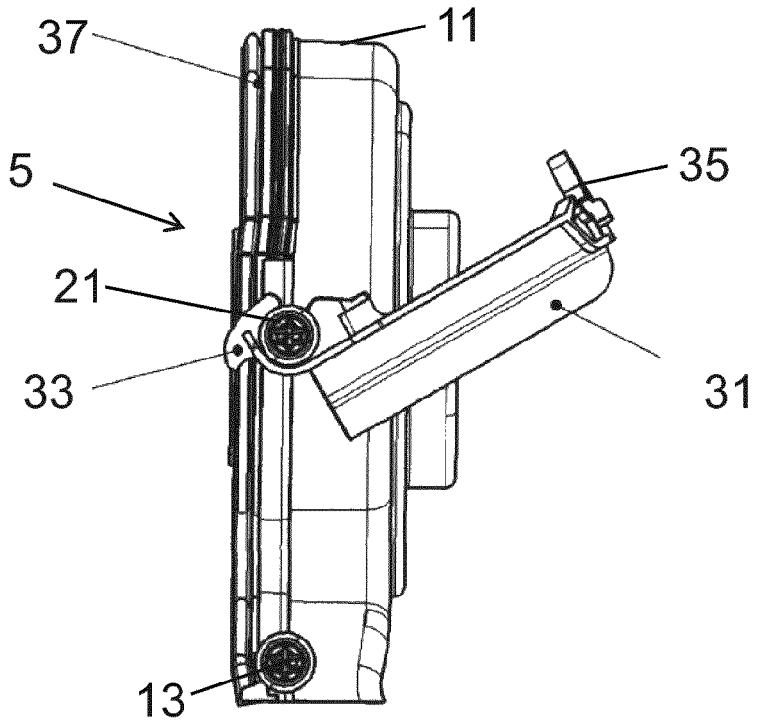
FIG. 2: a schematic diagram, looking from the side, of the fan with the mounting bracket open, in accordance with the first exemplary embodiment.

FIG. 2 shows a schematic diagram of a side view the fan 5 with the mounting bracket 31 open. As shown, the mounting bracket 31 is pivoted away from the fan 5. Here, the pivoting in this exemplary embodiment is about the pivot axis of the first bearing pin 13. In the view shown in FIG. 1, the mounting bracket 31 then pivots into or out of the plane of the illustration. In FIG. 2, a seal 37 can be seen on the left-hand side of the fan 5, this serving to seal the fan 5 with an evaporator. Locking hooks 33 are provided on the sides of the mounting bracket 31, and are used to engage with the bearing shell 4 when the mounting bracket 31 pivots, in order to affix the fan 5.

In accordance with one form of embodiment, a spring element can be provided to align the mounting bracket 31 elastically with the evaporator in its pivoting position. By this means, a defined positioning of the fan housing 11 by the mounting bracket 31 can be achieved. The mounting bracket 31 has, for example, at least one locking hook 33 for interlocking with a lock seat provided for this purpose on the evaporator. The lock seat can be designed as locking bolts, which the locking hook 33 can engage with from behind. Preferably, the locking hook 33 will be formed on the mounting bracket 31 in such a way that the locking hook 33 forms a unit with the mounting bracket 31.

The locking element 30 is mounted on the bearing pins 21, 22 of the fan housing 11, preferably so that it can rotate. The locking element 30 is, for example, made with locking hooks 33 on the ends of each of its sides. A rotational movement of the locking element 30 about its bearing axis then hooks the locking hooks 33 onto the locking bolts provided for this purpose on the bearing shell 4, where they are supported. This increases the rigidity of the joint between the fan housing 11 and the bearing shell 4.

In accordance with another form of embodiment there is at least one latching hook 35 arranged on the locking element 30, for a latching joint with the bearing shell 4 or with the evaporator. The latching hook 35 can be released from its engagement, for example by manual displacement.

For the purpose of fixing the locking element 30, the latching hook 35 which is located on the locking element 30 engages "audibly", for example, with the bearing shell 4, on a seat provide for this purpose. The audible engagement ensures that the operator can detect the latching operation particularly well. The geometry of the latching hook 35 is chosen, for example, such that when two latching hooks 35 which are arranged opposite each other are pressed together the latched joint can be released again, but if the closed latched joint is loaded with a tension, the latch hooks 35 spread out even further, in order to secure their engagement.

In accordance with one form of embodiment, an elastic seal is provided between the fan housing 11 and the bearing shell 4. This seal is attached to the fan housing 11 so that, for example, it cannot become dislodged, while it only makes contact with the bearing shell 4 to form a seal.

For the purpose of a gap-free seating of the fan housing 11 on the bearing shell 4, a positive-fit seal can be provided, for example on the front edge running around the fan housing, its geometry being chosen such that the rigid foot of the seal ensures its attachment to the fan housing so that it cannot become dislodged, while the lip of the seal seats flexibly onto the fan housing, with virtually no applied force. By this means, loss of air and hence loss of efficiency due to gaps, and structure-borne noise due to partial and intermittent seating of the fan housing on the bearing shell, are reduced.

Figure 3:
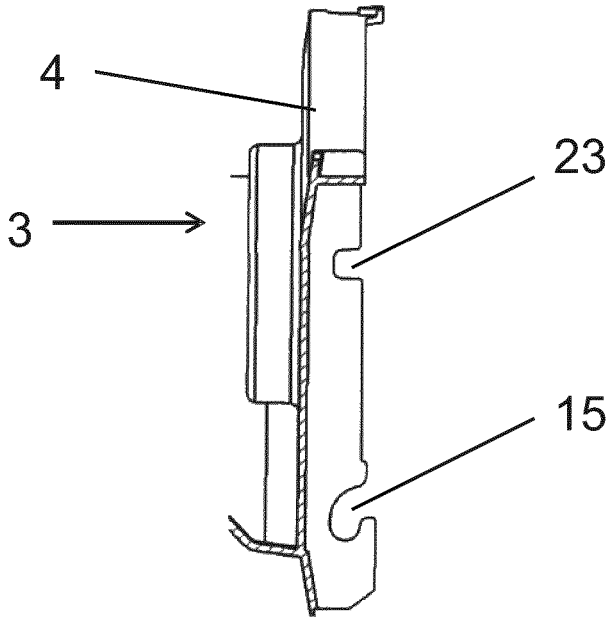
FIG. 3: a schematic diagram of a bearing shell for an evaporator in the refrigerating device, in accordance with the first exemplary embodiment.

FIG. 3 shows a side view of a bearing shell 4, which can be designed as an evaporator vessel of an evaporator 3. The bearing shell 4 has a first seating recess 15 and a second seating recess 23. The seating recesses 15, 23 are provided to seat the bearing pins 13, 21. To effect attachment on the fan 5, the bearing pins 13, 21 on the fan 5 are inserted into the recesses 15, 23, so that they take hold there.

Figure 4:
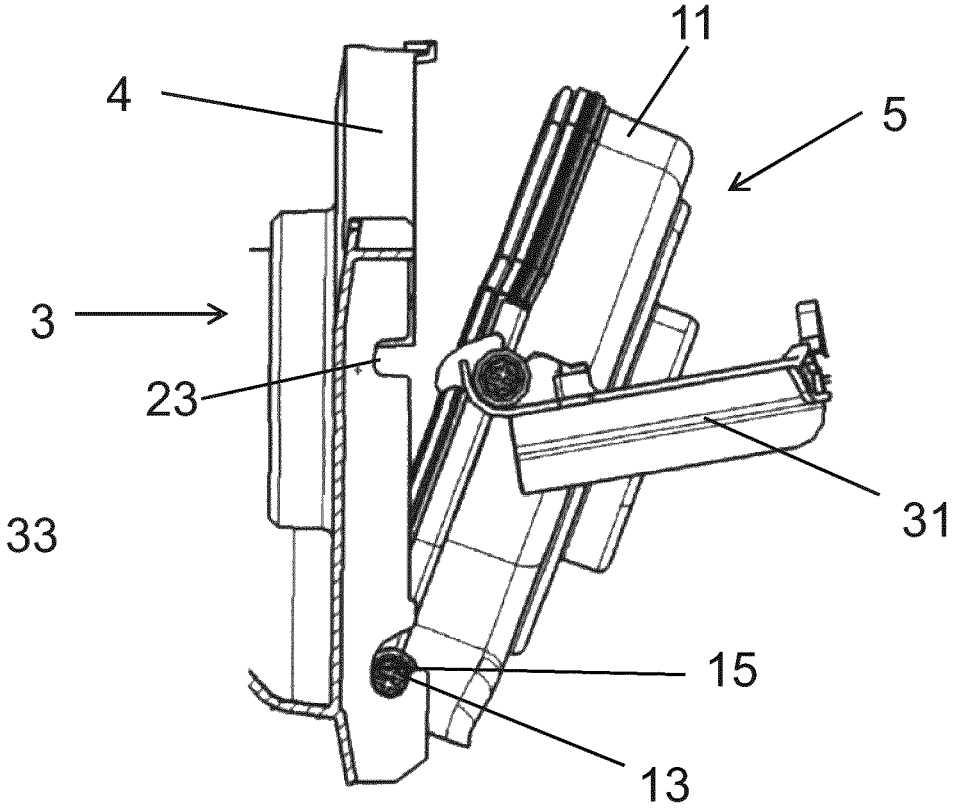
FIG. 4: a schematic diagram, looking from the side, of the evaporator with the fan attached to it, with the mounting bracket open, in accordance with the first exemplary embodiment.

FIG. 4 shows as a schematic diagram a side view of the evaporator 3 with the fan 5 attached and with the mounting bracket 31 open. The arrangement illustrated is that in which only the first bearing pin 13 on the fan 5 is engaged in the corresponding first seating recess 15 in the bearing shell 4. The second bearing pin 21 is still arranged at some distance from the second recess 23 associated with it. The first seating recess 15 is in the form of an elongated slot, so that when inserted the first bearing pin 13 can rest against the bearing shell 4 and holds the base of the fan 5 firmly onto the evaporator 3. In this case, the fan 5 remains pivotable about the pivot axis of the first bearing pin 13.

In the subsequent process to join together the fan 5 and the bearing shell 4, a pivoting of the fan 5 about the pivot axis of the first bearing pin 13 brings the second bearing pin 21 to rest in the second recess 23. As has been shown in FIG. 1, in FIG. 3 there are always in each case two recesses 15 or 23, as applicable, arranged behind each other or above each other, which are then engaged by the bearing pins 13, 21 respectively.

Figure 5:
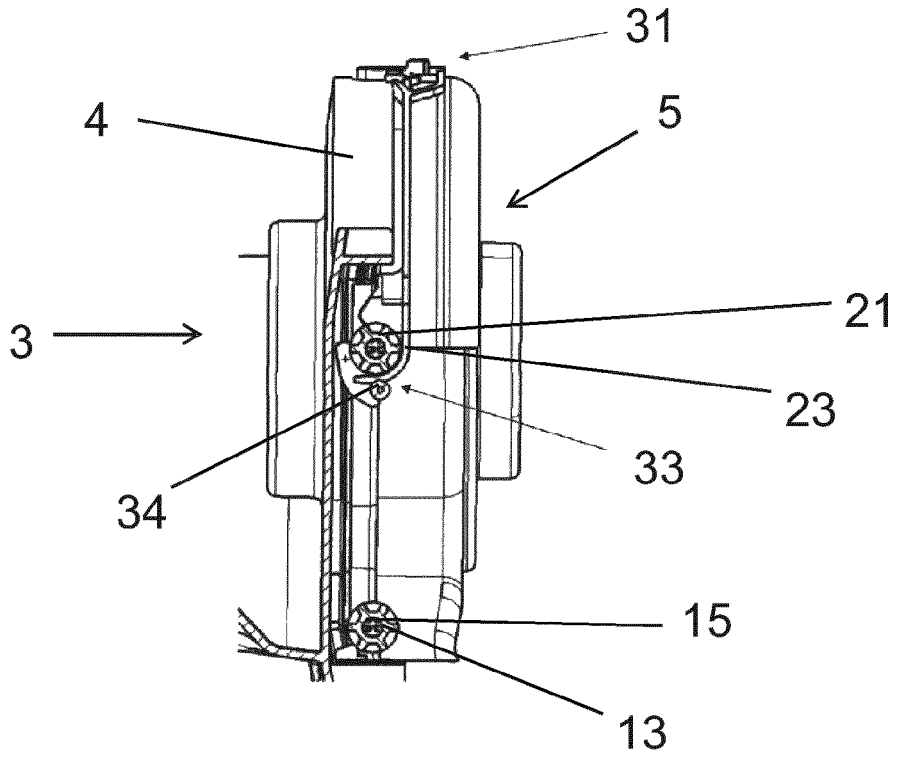
FIG. 5: a schematic diagram, looking from the side, of the evaporator with the fan attached to it, with the mounting bracket closed, in accordance with the first exemplary embodiment.

FIG. 5 shows as a side view a schematic diagram of the evaporator 3 with the fan 5 attached, with the locking element 30 closed. The arrangement shown is that in which the second bearing pin 21 on the fan 5 is also engaged in the corresponding second seating recess 23 on the fan 5. This arrangement arises from further pivoting the fan 5 about the axis of the first bearing pin 13 on the bearing shell 4, or towards the evaporator 3. By this, the mounting bracket 31 is now closed, and takes on the function of holding the evaporator 3 and the fan 5 in position.

Also provided on the mounting bracket 31 is a locking hook 33, which can engage from behind into a lock seat 34 provided on the bearing shell 4. In the case of this exemplary embodiment, the lock seat 34 is in the form of a lock bolt, which stands off from the bearing shell 4. When the fan 5 is pivoted about the first bearing pin 13, the locking hook 33 comes up against the lock bolt and levers the base of the fan 5 against the evaporator 3. Mechanical advantage results in the fan 5 being pressed against the bearing shell 4. By this means, and also by means of the seal 37, it is possible to achieve a particularly good seal between the evaporator 3 and the fan 5 while applying little force.

Figure 6:
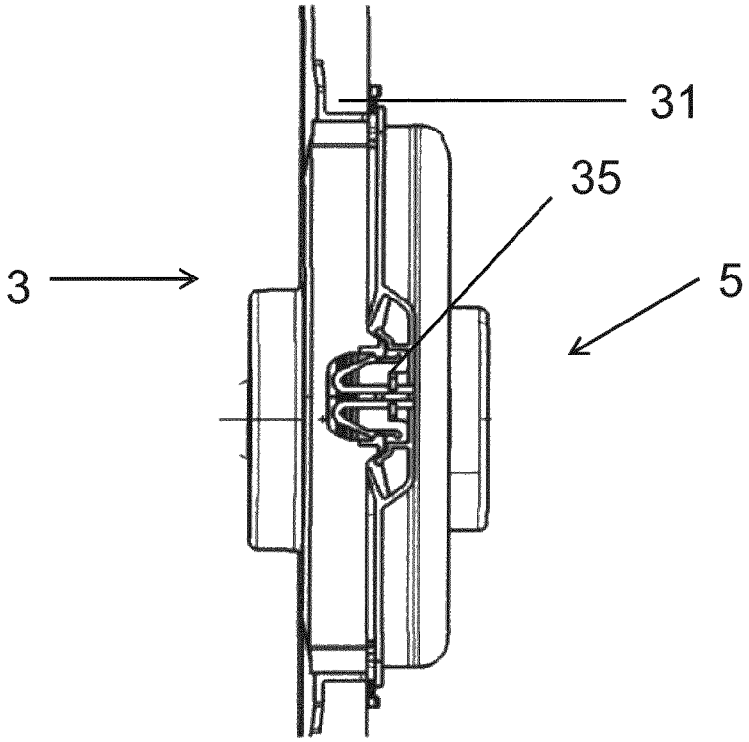
FIG. 6: a schematic diagram of a latching hook provided on the mounting bracket.

FIG. 6 shows a schematic diagram of a mounting bracket 31 with the latching hook 35. The latching hook 35 can be latched onto the evaporator 3 or the bearing shell 4, as appropriate, and avoids the unintentional releasing of the mounting bracket 31. For the purpose of fixing the end position of the mounting bracket 31, the latching hook 35 which is on the end of the mounting bracket 31 is latched into a seat provided for that purpose in the bearing shell.

In accordance with one form of embodiment, the fan solution combines the external rotor motor engineering with integrated air ducting. Because it is loss-free, this form of construction, in conjunction with the gap-free seating on the bearing shell, ensures a high ventilation capacity. Further, it provides a vibration-isolated, and thus noise minimizing, attachment of the fan 5 with integrated air ducting. The fan 5 is compact and at the same time can be securely and simply assembled. In the customer service situation, it is also easy to disassemble, and can be reliably re-assembled.

REFERENCE CHARACTERS USED

1 Refrigerating device
3 Evaporator
4 Bearing shell
5 Fan
11 Fan housing
13 First bearing pin
14 Third bearing pin
15 First recess
17 Damping element
21 Second bearing pin
22 Fourth bearing pin
23 Second recess
30 Locking element
31 Mounting bracket
33 Locking hook
34 Seat
35 Latching hook
37 Seal

The invention claimed is:

1. A refrigerating device comprising: an evaporator and a fan with a fan housing, the fan configured to generate airflow on the evaporator, a bearing shell configured to hold the fan housing onto the evaporator with vibration isolation, wherein the fan housing comprises at least one first bearing pin and a second bearing pin, wherein the bearing shell comprises at least one first seating recess which seats the first bearing pin, the fan housing being configured to pivot relative to the bearing shell such that a second seating recess seats the second bearing pin, and a pivotable locking element locks the second bearing pin in the second seating recess.

2. The refrigerating device as claimed in claim 1, wherein the first bearing pin and the second bearing pin are each provided with ring-shaped damping elements to isolate vibration.

3. The refrigerating device as claimed in claim 1, wherein the first bearing pin is disposed in the first seating recess and forms a pivot axis, wherein the fan housing is configured to pivot about the pivot axis relative to the bearing shell.

4. The refrigerating device as claimed in claim 1, wherein the second bearing pin is configured to pivot into the second seating recess.

5. The refrigerating device as claimed in claim 1, wherein the first seating recess is an elongated slot which is open on an edge, wherein the first bearing pin is inserted into the elongated slot.

6. The refrigerating device as claimed in claim 1, wherein the fan housing comprises a third bearing pin and a fourth bearing pin, the bearing shell comprises at least one third seating recess which seats the third bearing pin, the third bearing pin is configured to pivot, wherein the bearing shell comprises a fourth seating recess which seats the fourth bearing pin, wherein-the first bearing pin and the third bearing pin are arranged on opposite sides of the fan housing, wherein the second bearing pin and the fourth bearing pin are arranged on opposite sides of the fan housing, and wherein the locking element locks the fourth bearing pin in the fourth seating recess.

7. The refrigerating device as claimed in claim 6, wherein the bearing pins are attached to sides of the fan housing, and the seating recesses are formed in sides of the bearing shell.

8. The refrigerating device as claimed in claim 1, wherein at least one lock seat is provided on the bearing shell configured to lock the locking element.

9. The refrigerating device as claimed in claim 8, wherein the locking element comprises at least one locking hook configured to pivot and engage a locking bolt disposed behind the lock seat.

10. The refrigerating device as claimed in claim 8, wherein the locking element comprises a mounting bracket attached to the fan housing, wherein the mounting bracket is configured to pivot, and the locking hook is attached to the mounting bracket.

11. The refrigerating device as claimed in claim 8, wherein the second bearing pin is configured to lock by rotational movement of a mounting bracket about a bearing axis of the mounting bracket.

12. The refrigerating device as claimed in claim 8, wherein the mounting bracket is releasably latched to the bearing shell by a latching hook.

13. The refrigerating device as claimed in claim 8, wherein the mounting bracket is pivotably mounted on both sides of the bearing shell by the bearing pins in a locking position in which each of the bearing pins is locked into a corresponding seating recess, and the mounting bracket at least partially surrounds the bearing shell.

14. The refrigerating device as claimed in claim 1, wherein the bearing shell is attached to the evaporator or the bearing shell is formed by an evaporator vessel.

15. An assembly method for assembly of a fan with a fan housing in a refrigerating device comprising a bearing shell holding the fan housing with vibration isolation, wherein the fan housing has at least one first bearing pin and at least one second bearing pin, wherein the bearing shell has a first seating recess which seats the first bearing pin, wherein the fan housing is configured to pivot, wherein the bearing shell comprises a second seating recess which seats the second bearing pin, and a pivotable locking element locks the second bearing pin into the second seating recess, wherein the method comprises:

introducing the first bearing pin of the fan housing into the first seating recess of the bearing shell;

pivoting the second bearing pin into the second seating recess of the bearing shell by pivoting the fan housing towards the bearing shell about a pivot axis defined by the first bearing pin; and locking the second bearing pin into the second seating recess by the locking element.

16. A refrigerating device comprising:

an evaporator;

a fan with a fan housing configured to generate airflow on the evaporator;

a bearing shell securing the fan housing onto the evaporator with vibration isolation;

wherein the fan housing has at least one first bearing pin and a second bearing pin;

wherein the bearing shell has at least one first seating recess which seats the first bearing pin, wherein the fan housing is configured to pivot such that a second seating recess seats the second bearing pin; and a pivotable locking element secures the fan housing to the bearing shell.

17. The refrigerating device as claimed in claim 16, wherein the at least one first bearing pin and the second bearing pin are attached on sides of the fan housing, and wherein the seating recesses are formed in sides of the bearing shell.

18. The refrigerating device as claimed in claim 16, wherein the locking element comprises a pivotable mounting bracket attached to the fan housing, and a locking hook attached to the mounting bracket.

19. The refrigerating device as claimed in claim 16, wherein the second bearing pin locks by rotational movement of a mounting bracket about a bearing axis of the mounting bracket.

20. The refrigerating device as claimed in claim 19, wherein the mounting bracket is connected to the bearing shell by a releasable latching connection comprising a latching hook.

* * * * *